US006227315B1

(12) United States Patent
Debo et al.

(10) Patent No.: US 6,227,315 B1
(45) Date of Patent: May 8, 2001

(54) AIR JET EARTH-BORING BIT WITH NON-OFFSET CUTTERS

(75) Inventors: William L. Debo, Imperial, PA (US); Ted M. Ley, Cross Lanes, WV (US); Brian K. Smith, Brookville, PA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/046,160

(22) Filed: Mar. 23, 1998

(51) Int. Cl.[7] ..... E21B 10/16; E21B 10/18

(52) U.S. Cl. ..... 175/340; 175/341

(58) Field of Search ..... 175/340, 339, 175/341

(56) References Cited

U.S. PATENT DOCUMENTS

| | | | | |
|---|---|---|---|---|
| 2,320,137 | | 5/1943 | Kammerer . | |
| 2,682,389 | | 6/1954 | Baker . | |
| 2,717,762 | | 9/1955 | McGregor . | |
| 3,195,660 | | 7/1965 | McKown . | |
| 3,268,018 | * | 8/1966 | Neilson | 175/318 |
| 3,788,408 | * | 1/1974 | Dysart | 175/337 |
| 3,823,789 | | 7/1974 | Garner . | |
| 3,844,363 | * | 10/1974 | Williams, Jr. | 175/334 |
| 4,068,731 | | 1/1978 | Garner et al. . | |
| 4,245,710 | * | 1/1981 | Dolezal et al. | 175/356 |
| 4,293,048 | * | 10/1981 | Kloesel, Jr. | 175/227 |
| 4,386,668 | * | 6/1983 | Parish | 175/227 |
| 4,399,878 | * | 8/1983 | Karlsson et al. | 175/356 |
| 4,427,081 | * | 1/1984 | Crawford | 175/340 |
| 4,582,149 | | 4/1986 | Slaughter, Jr. . | |
| 4,687,067 | | 8/1987 | Smith et al. . | |
| 4,706,765 | * | 11/1987 | Lee et al. | 175/228 |
| 5,012,876 | | 5/1991 | Bruchmiller . | |
| 5,072,796 | | 12/1991 | Shen et al. . | |
| 5,439,068 | * | 8/1995 | Huffstutler | 175/340 |
| 5,497,841 | | 3/1996 | Cox et al. . | |
| 5,601,153 | | 2/1997 | Ensminger et al. . | |
| 5,624,002 | * | 4/1997 | Huffstutler | 175/376 |
| 5,853,055 | * | 12/1998 | Siracki et al. | 175/337 |

* cited by examiner

*Primary Examiner*—George Suchfield
(74) *Attorney, Agent, or Firm*—Felsman, Bradley, Vaden, Gunter & Dillon, LLP; James E. Bradley

(57) ABSTRACT

An earth-boring has a bit body with a geometric center about which the bit is designed to rotate. Three bearing shafts depend inwardly and downwardly from the bit body. A cutter is mounted for rotation on each bearing shaft and includes a plurality of cutting elements arranged in generally circumferential rows on the cutter. Each cutter and bearing shaft has substantially zero offset from geometric center of the bit body. A nozzle or drilling fluid orifice is carried generally in the geometric center of the bit body to discharge the gaseous drilling fluid from the bit body to the bit exterior.

11 Claims, 2 Drawing Sheets

AIR JET EARTH-BORING BIT WITH NON-OFFSET CUTTERS

TECHNICAL FIELD

The present invention relates to improvements in the hydraulics structure of earth-boring bits of the rolling cutter variety. More specifically, the present invention relates to rolling cutter bits having improved fluid-discharge-jet or nozzle arrangements.

BACKGROUND ART

The success of rotary drilling enabled the discovery of deep oil and gas reservoirs. The rotary rock bit was an important invention that made rotary drilling economical.

Only soft earthen formations could be penetrated commercially with the earlier drag bit, but the two-cone rock bit, invented by Howard R. Hughes, U.S. Pat. No. 930,759, drilled the hard caprock at the Spindletop Field near Beaumont, Tex., with relative ease. That venerable invention, within the first decade of this century, could drill a scant fraction of the depth and speed of the modern rotary rock bit. If the original Hughes bit drilled for hours, the modern bit drills for days.

Modern bits sometimes drill for thousands of feet instead of merely a few feet. Many advances have contributed to the impressive improvement of rotary rock bits.

In drilling boreholes in earthen formations by the rotary method, rock bits fitted with one, two, or three rolling cutters are employed. The bit is secured to the lower end of a drillstring that is rotated from the surface or by downhole motors or turbines. The cutters mounted on the bit roll and slide upon the bottom of the borehole as the drillstring is rotated, thereby engaging and disintegrating the formation material to be removed. The roller cutters are provided with teeth or cutting elements that are forced to penetrate and gouge the bottom of the borehole by weight from the drillstring. The cuttings from the bottom and sidewalls of the borehole are washed away by drilling fluid that is pumped down from the surface through the hollow, rotating drillstring are carried in suspension in the drilling fluid to the surface. The drilling fluid discharge onto the bottom and sidewalls of the borehole through nozzles or jets carried by the bit.

Typically, the drilling fluid is a liquid (water or oil) with a solid material in suspension. Liquid drilling fluid or mud circulates in the borehole to cool and lubricate the bit, wash away cuttings, protect the uncased formation against sloughing and caving, and to provide a hydrostatic pressure column in the borehole to counteract pressure imbalances in the borehole.

Air or a gaseous drilling fluid is known to permit high rates of penetration when it can be used. However, because of its reduced density and tendency to form explosive mixtures with natural gas in the borehole, air or gas is not used as a drilling fluid in most applications.

The design and arrangement of the nozzles or jets of a bit has been the subject of a good deal of study. In general terms, the nozzles can be designed to discharge fluid primarily for one of two purposes: to maximize cleaning of the cutting structure of the bit and washing of cuttings from the bottom of the borehole, or to impinge directly upon the bottom and sides of the borehole in an attempt to aid the bit cutting structure in disintegrating formation material.

Under certain drilling conditions, liquid drilling mud systems have the effect of actually confining cuttings at the bottom of the borehole, where they are reground to a very fine consistency and contribute to bit balling and abrasive wear of the components of the bit.

DISCLOSURE OF INVENTION

It is a general object of the present invention to provide an earth-boring bit for drilling with air or gaseous cutting fluids that divides a nozzle or jet arrangement allowing for improved rates of penetration of earthen formations.

This and other objects are achieved by providing and earth-boring having a bit body with a geometric center about which the bit is designed to rotate. At least a pair of, and preferably three, bearing shafts depend inwardly and downwardly from the bit body. A cutter is mounted for rotation on each bearing shaft and includes a plurality of cutting elements arranged in generally circumferential rows on the cutter. Each cutter and bearing shaft has substantially zero offset from geometric center of the bit body. A nozzle or drilling fluid orifice is carried generally in the geometric center of the bit body to discharge the gaseous drilling fluid from the bit body to the bit exterior.

According to the preferred embodiment of the present invention, a sealed and lubricated bearing is defined between each cutter and its respective bearing shaft.

According to the preferred embodiment of the present invention, a nozzle is carried by the bit body and associated with each cutter in a location adjacent the cutter. According to the preferred embodiment of the present invention, the drilling fluid is air, but may also be an air/water mixture.

BEST MODE FOR CARRYING OUT INVENTION

Figure 1:
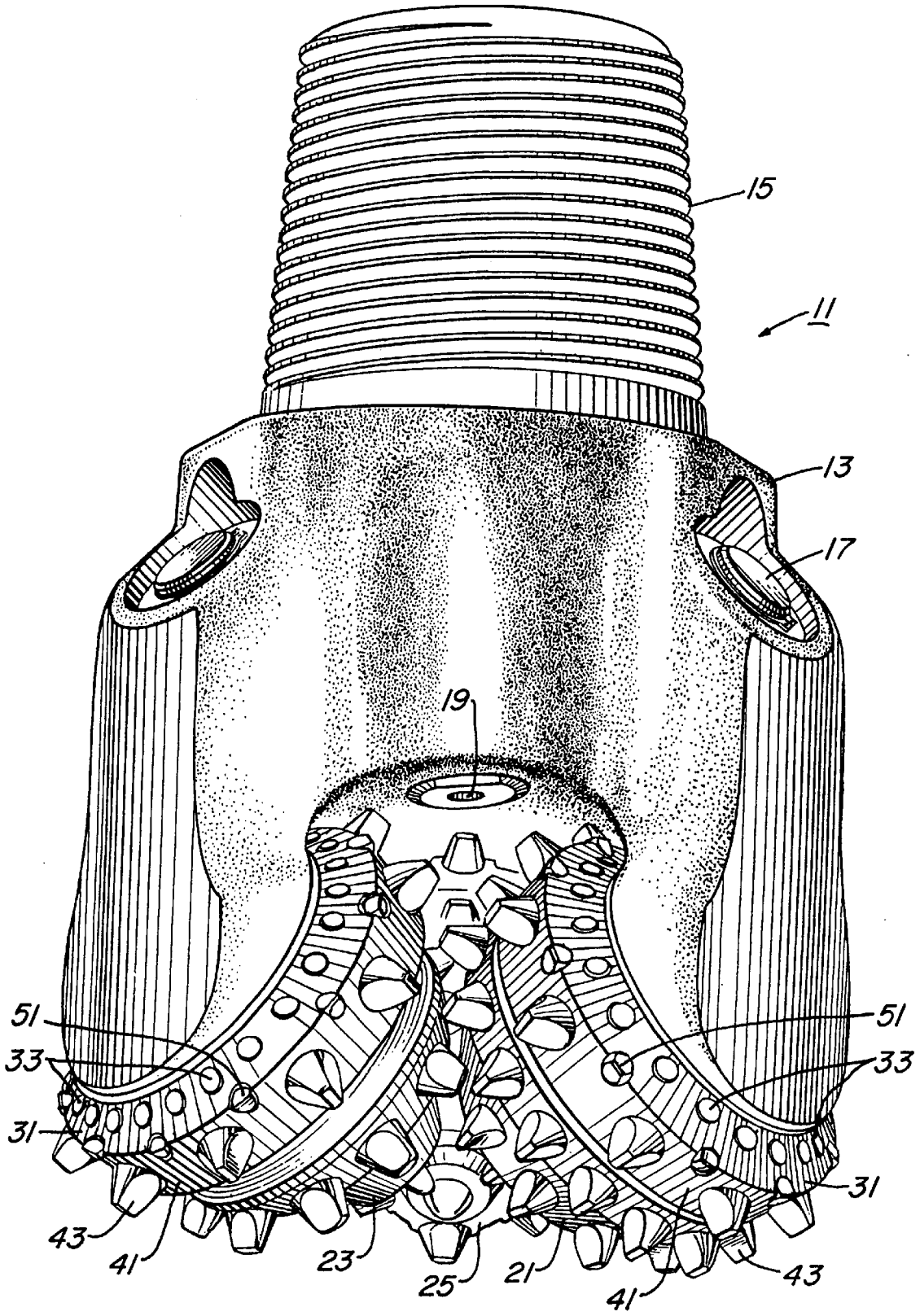
FIG. 1 is a perspective view of an earth-boring bit of the rolling cutter variety according to the present invention.

Referring now to the Figures and to particularly to FIG. 1, an earth-boring bit 11 according to the present invention is illustrated. Bit 11 includes a bit body 13, which is threaded at its upper extent 15 for connection im into a drill string. Each leg or section of bit 11 is provided with a lubricant compensator 17. Lubricant compensator 17 equalizes pressure in bearing lubricant in the bit and urges the lubricant into the bearings of bit 11, which preferably comprises an elastomer or o-ring sealed journal bearing.

As discussed in greater detail with reference to FIG. 2, a plurality of nozzles 19 is provided in bit body 13 to spray drilling fluid from within the drillstring to cool and lubricate bit 11 during drilling operation. Three cutters 21, 23, 25 are rotatably secured to a bearing shaft associated with each leg of bit body 13.

Each cutter 21, 23, 25 has a cutter shell surface including a gage surface 31 and a heel surface 41. A plurality of cutting elements are arranged in generally circumferential rows on the cutter shell surface. Cutting elements preferably are secured in apertures in the cutters by interference fit and include gage cutting elements 33 on gage surface 31, heel cutting elements 43 on heel surfaces 41, and several inner rows of cutting elements. Gage trimmer or scraper elements 51 are provided generally at the intersection of gage 31 and heel 41 surfaces as disclosed in commonly assigned U.S. Pat. Nos. 5,351,768 and 5,479,997 to Scott et al.

Figure 2:
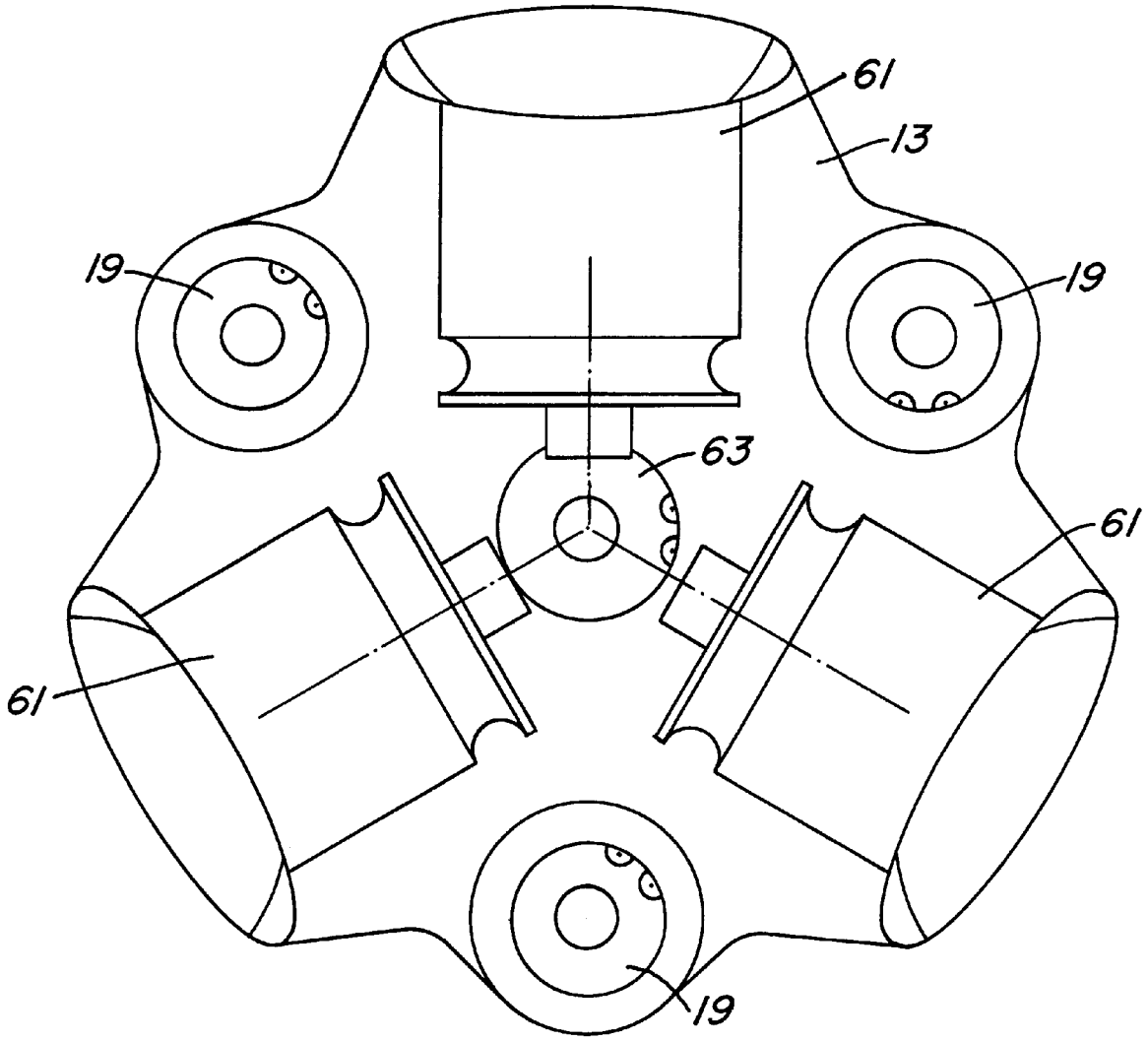
FIG. 2 is plan view, looking upward at a bit body with the cutters removed, of an earth-boring bit according to the present invention.

FIG. 2 is an plan view of bit 11 looking upward with the cutters removed. As can be seen, each bearing shaft 61 is provided with a cylindrical journal bearing surface upon which each cutter rotates. Further the longitudinal axis of each bearing shaft intersects the geometric center of bit body 13. The geometric center of bit body 13 is the point about which bit 11 is designed to rotate. With the axes of the shafts 61 intersecting the geometric center, the bearing shafts and cutters are said to have zero or no offset and the cutters have a true rolling action over the bottom of the borehole, with a minimum of sliding associated with offset cutters.

In addition to the three conventional nozzles 19 at the periphery of bit body 13 and associated with cutters 21, 23, 25, a center jet or nozzle 63 is provided at the geometric center of bit body 13.

We claim:

1. An earth-boring bit comprising:

a bit body having a geometric center and a threaded coupling on an upper end for connection to a drill string, the bit body adapted to receive a gaseous drilling fluid pumped down the drill string;

at least a pair of bearing shafts depending inwardly and downwardly from the bit body;

a cutter mounted for rotation on each bearing shaft, the cutter including a plurality of cutting elements arranged in generally circumferential rows on the cutter, each cutter mounted on the bearing shaft having substantially zero offset from the geometric center of the bit body; and an orifice generally in the geometric center of the bit body for discharging at least a portion of the gaseous drilling fluid from the bit body to the bit exterior.

2. The earth-boring bit according to claim 1 further comprising:

a nozzle associated with each cutter and carried by the bit body in a location adjacent each cutter and spaced outward from the geometric center for discharging a portion of the gaseous drilling fluid.

3. The earth-boring bit according to claim 1 wherein the gaseous drilling fluid is air.

4. The earth-boring bit according to claim 1 wherein the gaseous drilling fluid is an air-water mixture.

5. An earth-boring bit comprising:

a bit body having a geometric center and a threaded upper end for connection to a drill string, the bit body adapted to receive a gaseous fluid pumped down the drill string;

three bearing shafts depending inwardly and downwardly from the bit body, each bearing shaft being non-offset from the geometric center of the bit body;

a cutter mounted for rotation on each bearing shaft with no offset relative to the geometric center of the bit body, the cutter including a plurality of cutting elements arranged on the cutter; and an orifice carried generally in the geometric center of the bit body for discharging at least a portion of the gaseous drilling fluid from the bit body to the bit exterior.

6. The earth-boring bit according to claim 5 further comprising:

a nozzle associated with each cutter and carried by the bit body in a location adjacent each cutter.

7. The earth-boring bit according to claim 5 wherein the gaseous drilling fluid is air.

8. The earth-boring bit according to claim 5 wherein the gaseous drilling fluid is an air-water mixture.

9. An earth-boring bit comprising:

a bit body having a geometric center, the bit body having a threaded upper end for connection to a drill string, the bit body adapted to receive a gaseous drilling fluid pumped down the drill string;

at least a pair of bearing shafts depending inwardly and downwardly from the bit body;

a cutter mounted for rotation on each bearing shaft, the cutter including a plurality of cutting elements arranged in generally circumferential rows on the cutter, each cutter mounted on each bearing shaft having substantially zero offset from the geometric center of the bit body;

at least one orifice located generally in the geometric center of the bit body for discharging a portion of the gaseous drilling fluid from the bit body to the bit exterior; and a nozzle associated with each cutter and carried by the bit body in a location adjacent each cutter and outward from the geometric center for discharging another portion of the gaseous drilling fluid.

10. The earth-boring bit according to claim 9 wherein the gaseous drilling fluid is air.

11. The earth-boring bit according to claim 9 wherein the gaseous drilling fluid is an air-water mixture.

* * * * *

UNITED STATES PATENT AND TRADEMARK OFFICE

CERTIFICATE OF CORRECTION

PATENT NO. : 6,227,315 B1
DATED : May 8, 2001
INVENTOR(S) : William L. Debo et al.

It is certified that error appears in the above-identified patent and that said Letters Patent is hereby corrected as shown below:

Column 1,
Line 41, delete "are" and substitute therefor -- and --
Line 42, delete "discharge" and substitute therefor -- discharges --

Column 2,
Line 10, delete "and" and substitute therefor -- an --
Line 11, after "earth-boring" insert -- bit --
Line 45, delete "im"

Signed and Sealed this

Eleventh Day of December, 2001

*Attest:*

Nicholas P. Godici

*Attesting Officer*

NICHOLAS P. GODICI
*Acting Director of the United States Patent and Trademark Office*